US010226105B2

(12) United States Patent
Hsu

(10) Patent No.: US 10,226,105 B2
(45) Date of Patent: Mar. 12, 2019

(54) STRAP CONNECTOR OF BODY FITTING DEVICE

(71) Applicant: TIE XIN INDUSTRIAL CO., LTD., Changhua County (TW)

(72) Inventor: Yu Wei Hsu, Changhua County (TW)

(73) Assignee: TIE XIN INDUSTRIAL CO., LTD., Changhua County (TW)

( * ) Notice: Subject to any disclaimer, the term of this patent is extended or adjusted under 35 U.S.C. 154(b) by 83 days.

(21) Appl. No.: 15/604,679

(22) Filed: May 25, 2017

(65) Prior Publication Data

US 2018/0338584 A1 Nov. 29, 2018

(51) Int. Cl.

| | |
|---|---|
| ***A44B 11/16*** | (2006.01) |
| ***A63B 23/02*** | (2006.01) |
| ***A63B 23/12*** | (2006.01) |
| ***A63B 21/00*** | (2006.01) |
| ***A63B 21/06*** | (2006.01) |

(52) U.S. Cl.

CPC ..... *A44B 11/16* (2013.01); *A63B 21/06* (2013.01); *A63B 21/40* (2015.10); *A63B 23/02* (2013.01); *A63B 23/12* (2013.01)

(58) Field of Classification Search

CPC ... A44B 11/16; A44B 11/065; Y10T 24/2164; Y10T 24/2192; Y10T 24/3403; Y10T 24/3404

See application file for complete search history.

(56) References Cited

U.S. PATENT DOCUMENTS 3,121,272 A * 2/1964 Matthews ..... B68B 5/00 24/196
3,591,900 A * 7/1971 Brown ..... A44B 11/10 24/196

* cited by examiner

*Primary Examiner* — Robert Sandy
(74) *Attorney, Agent, or Firm* — Leong C. Lei

(57) ABSTRACT

A strap connector of a body fitting device generally includes a connector body, which includes a first movement space and a second movement space that is separated from the first movement space; a first movable block, which is slidably mounted to the connector body and is received in the first movement space and is reciprocally slidable upon being acted upon by an external force; a second movable block, which is slidably mounted to the connector body and is received in the second movement space and is reciprocally slidable upon being acted upon by an external force; and an elastic assembly, which is in contact engagement with and positioned between the connector body and the second movable block to provide an elastic cushioning force to the second movable block.

14 Claims, 12 Drawing Sheets

STRAP CONNECTOR OF BODY FITTING DEVICE

(a) TECHNICAL FIELD OF THE INVENTION

The present invention relates generally to a body fitting device, and more particularly to a strap connector of a body fitting device.

(b) DESCRIPTION OF THE PRIOR ART

The human population of the word is continuously increasing and this leads to an increasingly concentrated building arrangement in an urban area, while outdoor spaces are increasingly diminishing. Consequently, spaces for outdoor activity of people are reduced.

Gyms are now commonly established in metropolises and cities to provide indoor spaces for exercises for urban people. One of the most favorite exercise devices that are often available in the gyms is a tension device, which is structured for people to train their arm strength and chest muscles by using a strap connected between a grip and a weight, so that a user may hold the grip and pull the weight through the strap for exercising and training purposes.

To prevent an over-stiff connection for operation of a tension device, two straps are often used for connection, where a first one has an end coupled to the weight and an opposite end coupled to a connector and a second one has an end coupled to the grip and an opposite end coupled to the connector so that the connector functions as a connection interface between the two straps. In this way, the connector that has an adjustable space provides a flexible connection of the straps at the time when an initial pull is made. However, the adjustable or movable clearance provided in the connector makes the user feel sudden impact during pulling of the straps. This causes discomfort of the user and may also readily lead to undesired stretching of muscles of the user.

SUMMARY OF THE INVENTION

In view of the problems, to improve the prior art, where a strap connector of a known body fitting device may readily causes impact and may cause no-resistance pulling, leading to discomfort of operation and damage to human body, the present invention provides a strap connector of a body fitting device, which generally comprises: a connector body, which comprises a first movement space and a second movement space that is separated from the first movement space; a first movable block, which is slidably mounted to the connector body and is received in the first movement space and is reciprocally slidable upon being acted upon by an external force; a second movable block, which is slidably mounted to the connector body and is received in the second movement space and is reciprocally slidable upon being acted upon by an external force; and an elastic assembly, which is in contact engagement with and positioned between the connector body and the second movable block to provide an elastic cushioning force to the second movable block. As such, impact occurring during a sliding movement of the second movable block can be eliminated to provide a comfortable effect of pulling to a user and also to effectively protect the user from potential risk of damage caused by non-resistance pulling during a pulling operation.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
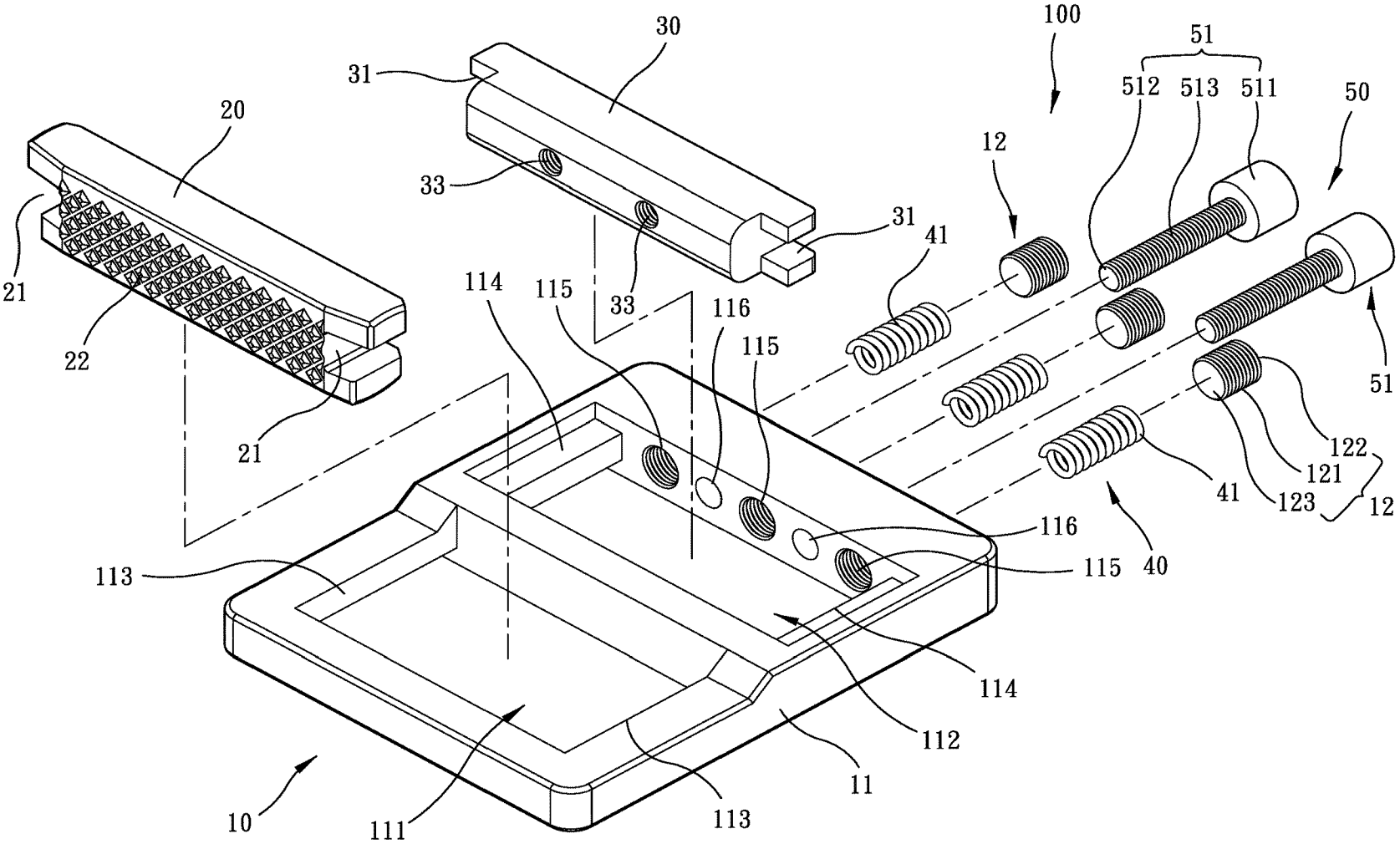
FIG. 1 is an exploded view illustrating a preferred embodiment of the present invention.
Figure 2:
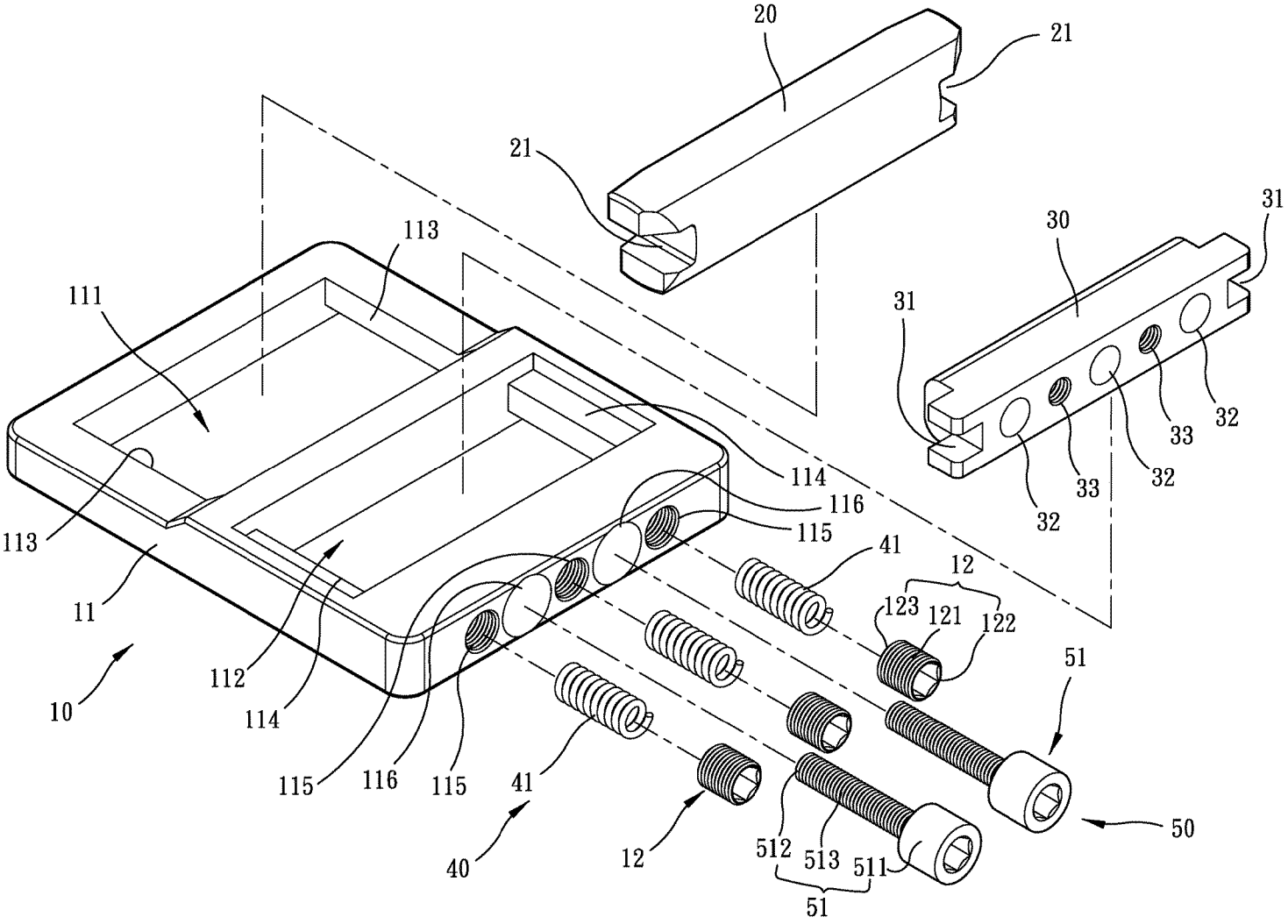
FIG. 2 is an exploded view illustrating the preferred embodiment of the present invention from a different perspective.
Figure 3:
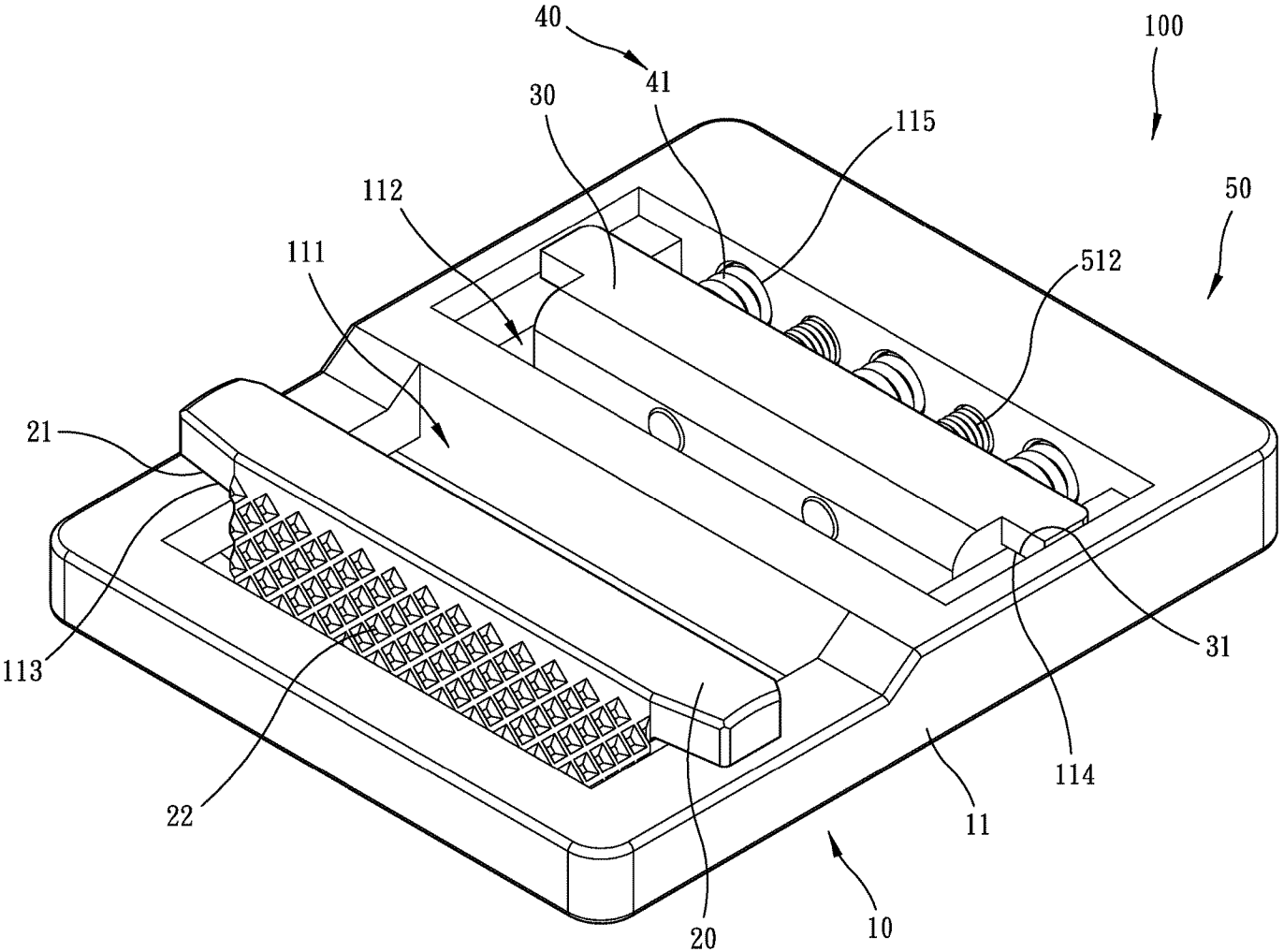
FIG. 3 is a perspective view showing an assembled condition of the embodiment of FIG. 1.
Figure 4:
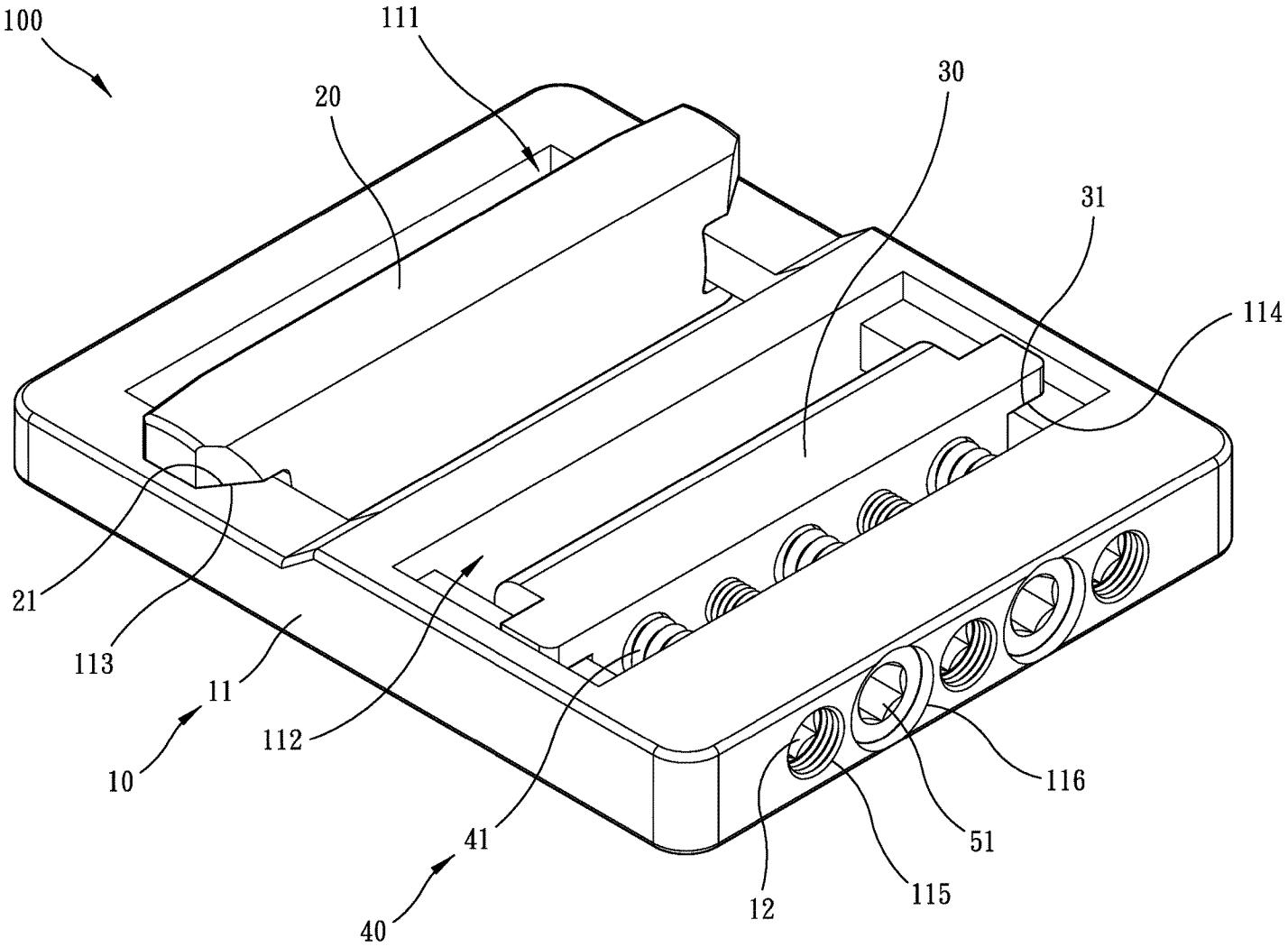
FIG. 4 is a perspective view showing an assembled condition of the embodiment of FIG. 1 taken from a different perspective.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-9, a strap connector 100 according to a first embodiment is provided for use with a body fitting device and generally comprises a connector body 10, a first movable block 20, a second movable block 30, an elastic assembly 40, and a guide assembly 50.

Referring to FIGS. 1-4, the connector body 10 comprises a connector base 11 and three regulators 12. The connector base 11 comprises an integrally formed unitary structure in the form of a rectangular frame, which comprises, formed in an interior thereof, a first movement space 111 and a second movement space 112 that is separated from the first movement space 111. The first movement space 111 has two opposite inside surfaces each of which is provided with a first movement rail 113; the second movement space 112 has two opposite inside surfaces each of which is provided with a second movement rail 114. The connector base 11 has an end wall that comprises three threaded holes 115 and two through holes 116, which are each located two adjacent ones of the thread holes 115, formed therein to extend from an outside surface thereof to the second movement space. The regulators 12 are each a head-less bolt and the regulators 12 each have an outer circumferential surface on which an external thread 121 is formed. The regulators 12 each have an end that forms a driving section 122 and an opposite end that forms an engaging section 123, wherein the driving section 122 comprises a hexagonal hole. The regulators 12 are respectively screwed into the threaded holes 115 of the connector base 11 by means of the external thread 121 thereof such that the engaging sections 123 face and point toward the second movement space 112.

Referring to FIGS. 1-4, the first movable block 20 has two lateral ends each formed with a first movement channel 21, and the first movable block 20 has one side that comprises a roughened surface 22. The first movement channels 21 of the first movable block 20 are respectively set in sliding engagement with the first movement rails 113 of the connector body 10 so that the first movable block 20 is located in the first movement space 111 and is, upon being acted by an external force, reciprocally slidable within the first movement space 111 along the first movement rails 113.

Referring to FIGS. 1-4, the second movable block 30 has two lateral ends each formed with a second movement channel 31, and the second movable block 30 has one side formed with three constraint holes 32 and two connection holes 33 each of which is located between two adjacent ones of the constraint holes 32, wherein in the instant embodiment, the connection holes 33 are threaded holes. The second movement channels 31 of the second movable block 30 are respectively set in sliding engagement with the second movement rails 114 of the connector body 10 so that the second movable block 30 is located in the second movement space 112 and is, upon being acted by an external force, reciprocally slidable within the second movement space 112 along the second movement rails 114.

Referring to FIGS. 1-4, the elastic assembly 40 comprises three springs 41, and the springs 41 are arranged in the second movement space 112 of the connector body 10 and are respectively in contact engagement with and located between the engaging sections 123 of the regulators 12 mounted to the end wall of the connector body 10 and the constraint holes 32 of the second movable block 30 to provide an preloaded elastic cushioning force to the second movable block 30.

Referring to FIGS. 1-4, the guide assembly 50 comprises two guide members 51, and the guide members 51 are each in the form of a bolt. The guide members 51 each comprise a head portion 511 and a shank portion 512 integrally formed with and coaxially connected to the head portion 511. The head portion 511 has an outside diameter that is greater than an outside diameter of the shank portion 512 and the shank portion 512 has an outer circumferential surface on which an external thread 513 is formed. The guide members 51 are arranged such that the shank portions 512 are respectively received through the through holes 116 of the connector body 10 and are set in screwing engagement with the connection holes 33 of the second movable block 30 through the external threads 513 thereof.

Figure 5:
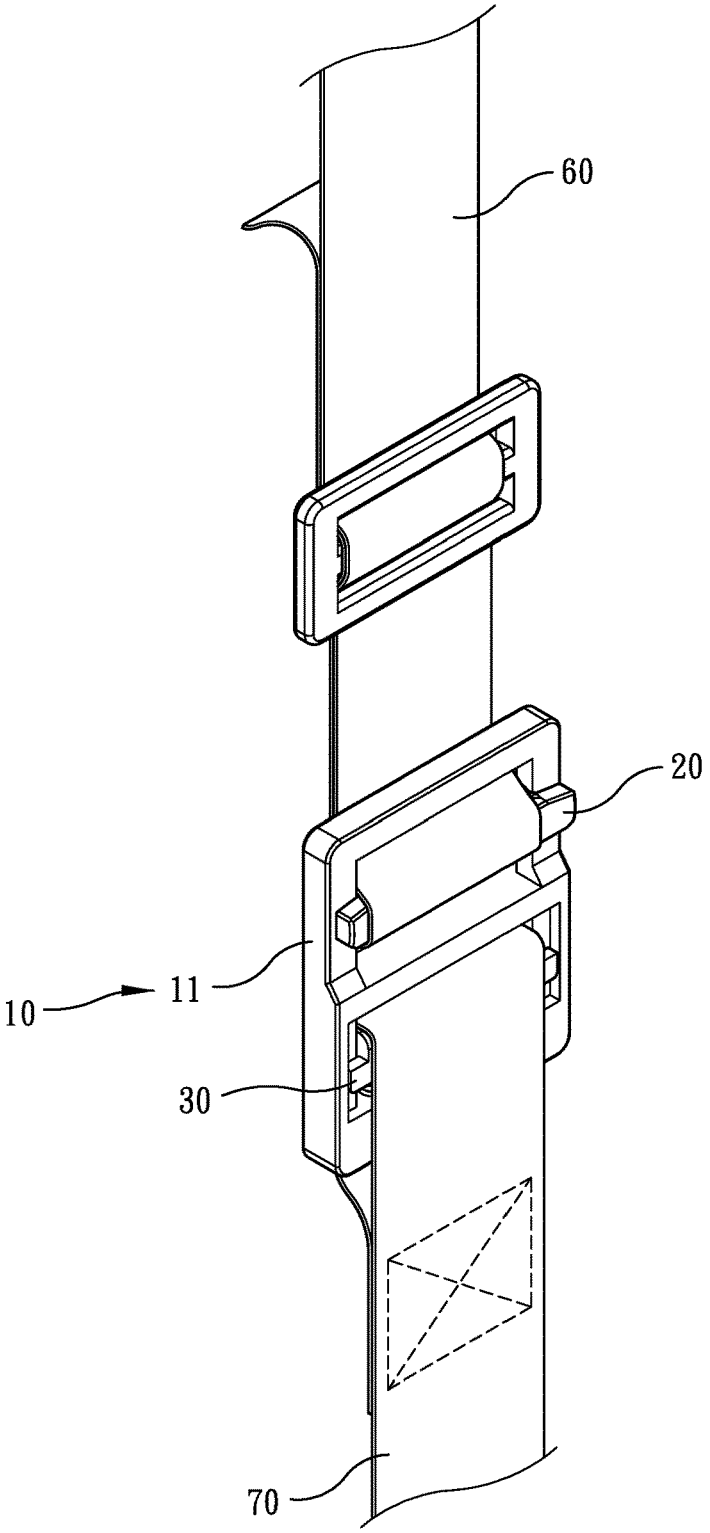
FIG. 5 is a perspective view demonstrating a use of the embodiment of FIG. 1.
Figure 6:
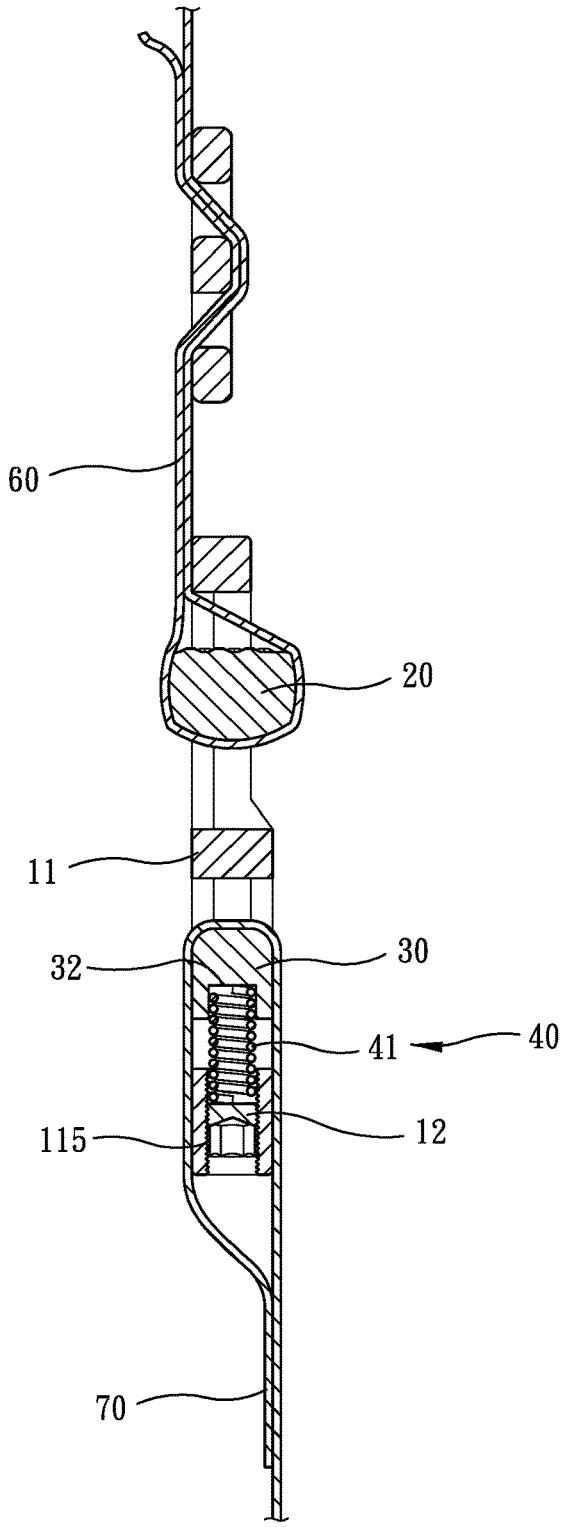
FIGS. 6-9 are cross-sectional views illustrating an operation of the embodiment of FIG. 1

The above provides descriptions concerning structure and assembly of each of the components that make up the strap connector 100 of a body fitting device according to the first embodiment of the present invention. An operation of the invention will be described below:

To use the present invention, as shown in FIGS. 5 and 6, the first strap 60 is wrapped around and coupled to the first movable block 20 and is then securely attached to a body fitting device (such as a tension device) (not shown in the drawings) and the second strap 70 is wrapped around and coupled to the second movable block 30.

Figure 7:
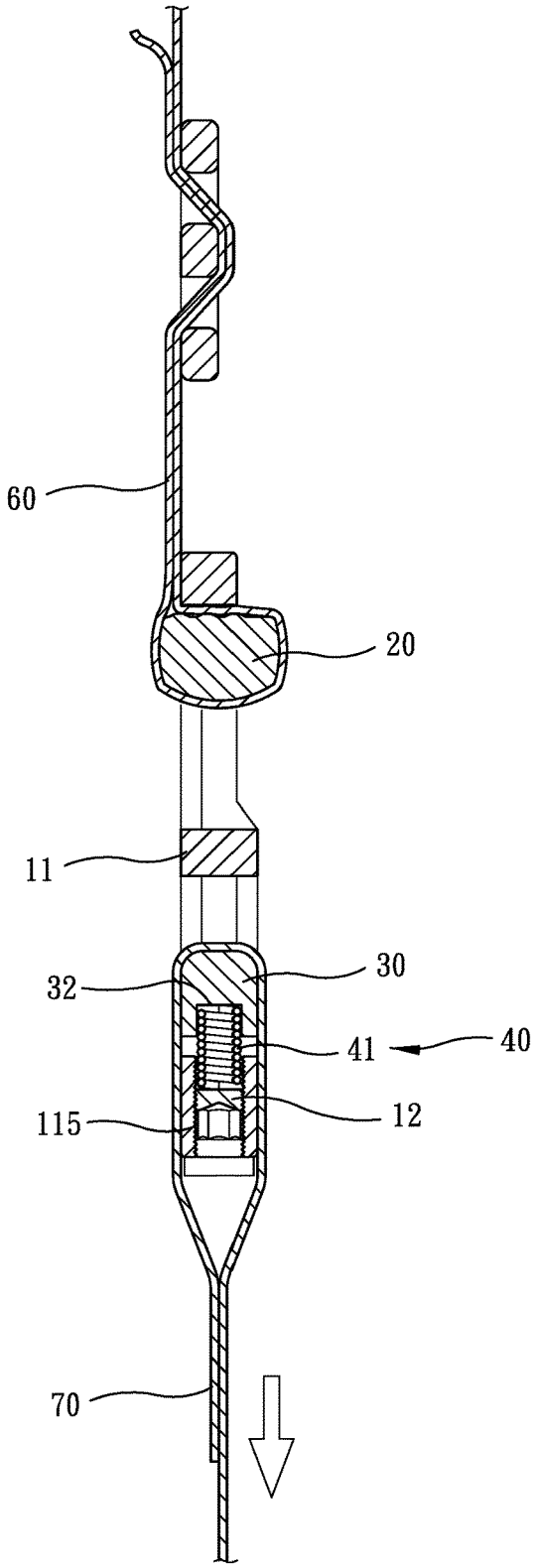

When a user pulls the second strap 70, as shown in FIG. 7, the second movable block 30 is driven by the second strap 70 and slides in a direction toward the elastic assembly 40 so as to compress the springs 41, wherein during the sliding movement of the second movable block 30, the elastic forces generated by the springs 41 provide a cushioning force for an impact caused by the operation to prevent a shocking impact from occurring on the second movable block 30 during the sliding movement. In this way, the user is provided a better effect of exercise through pulling and is also protected against any potential risk of damage caused by momentary no-resistance sliding.

Figure 8:
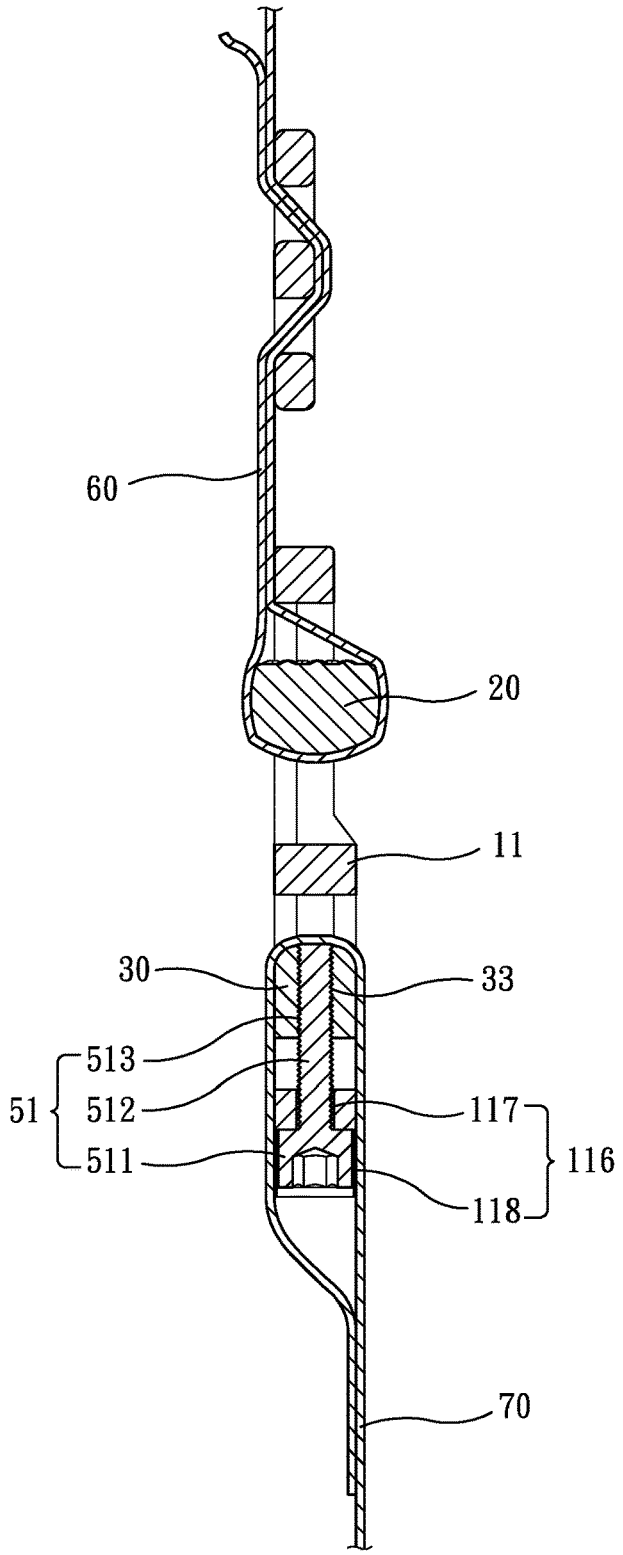
Figure 9:
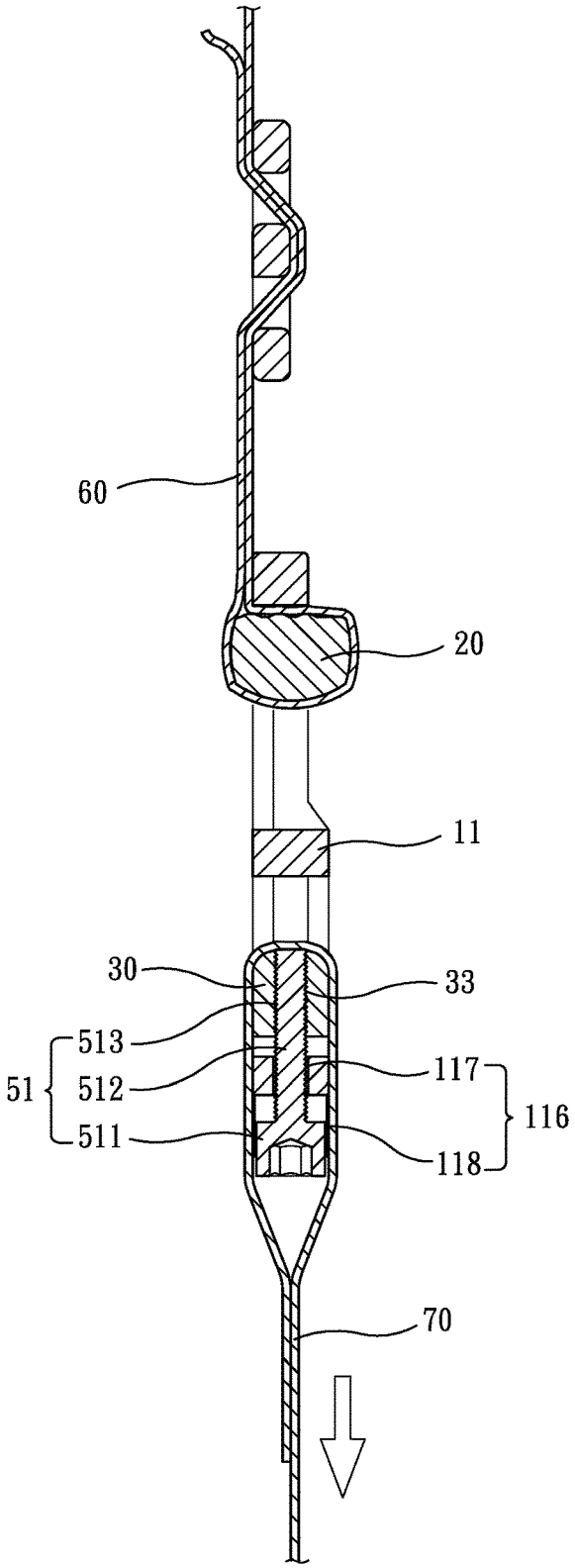

Further, when the second movable block 30 is driven and moved by the second strap 70, as shown in FIGS. 8 and 9, due to the engagement between the second movable block 30 and the guide assembly 50, the second movable block 30 is guided to conduct smooth sliding so as to prevent skewing of the second movable block 30 during the sliding movement thereof and to maintain the smoothness of sliding of the second movable block 30.

Further, in the above embodiment, the through holes 116 of the connector body 10 are each constructed to include a small bore or aperture 117 in communication with the second movement space 112 and a large bore or aperture 118 that is coaxially connected to the small aperture 117 and is in communication with the outside. The head portions 511 of the guide members 51 of the guide assembly 50 have an outside diameter that is less than a bore diameter of the large apertures 118 of the connector body 10 and greater than a bore diameter of the small aperture 117, while the shank portions 512 have an outside diameter that is less than the bore diameter of the small apertures 117 of the connector body 10. In this way, the small apertures 117 are sized to allow the shank portions 512 to respectively extend therethrough and the large apertures 118 are sized to hold and keep the head portions 511 therein (as shown in FIG. 5) to prevent undesired projection of the parts and thus improve product competition power in the market.

Further, in the above embodiment, the springs 41 of the elastic assembly 40 are set in contact engagement with the engaging sections 123 of the regulators 12 of the connector body 10 so that a user may use a tool (such as hexagonal spanner) to engage and rotate the driving sections 122 to adjust positions of the regulators 12 for applying different forces acting on the springs 41 to thereby achieve an effect of adjusting and regulating the pre-loaded elastic force of the springs 41.

Figure 10:
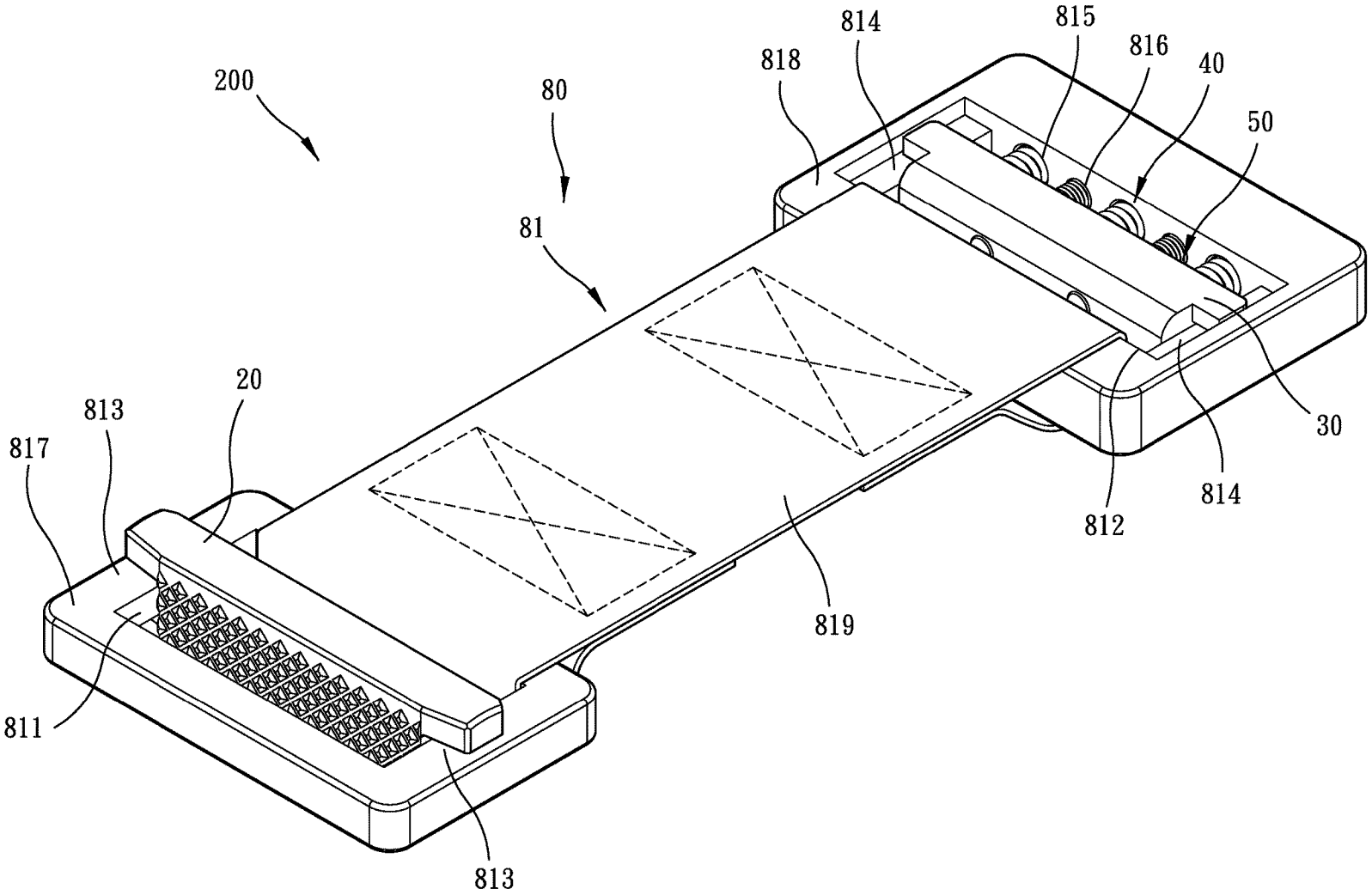
FIG. 10 is a perspective view illustrating a second embodiment of the present invention in an assembled form.
Figure 11:
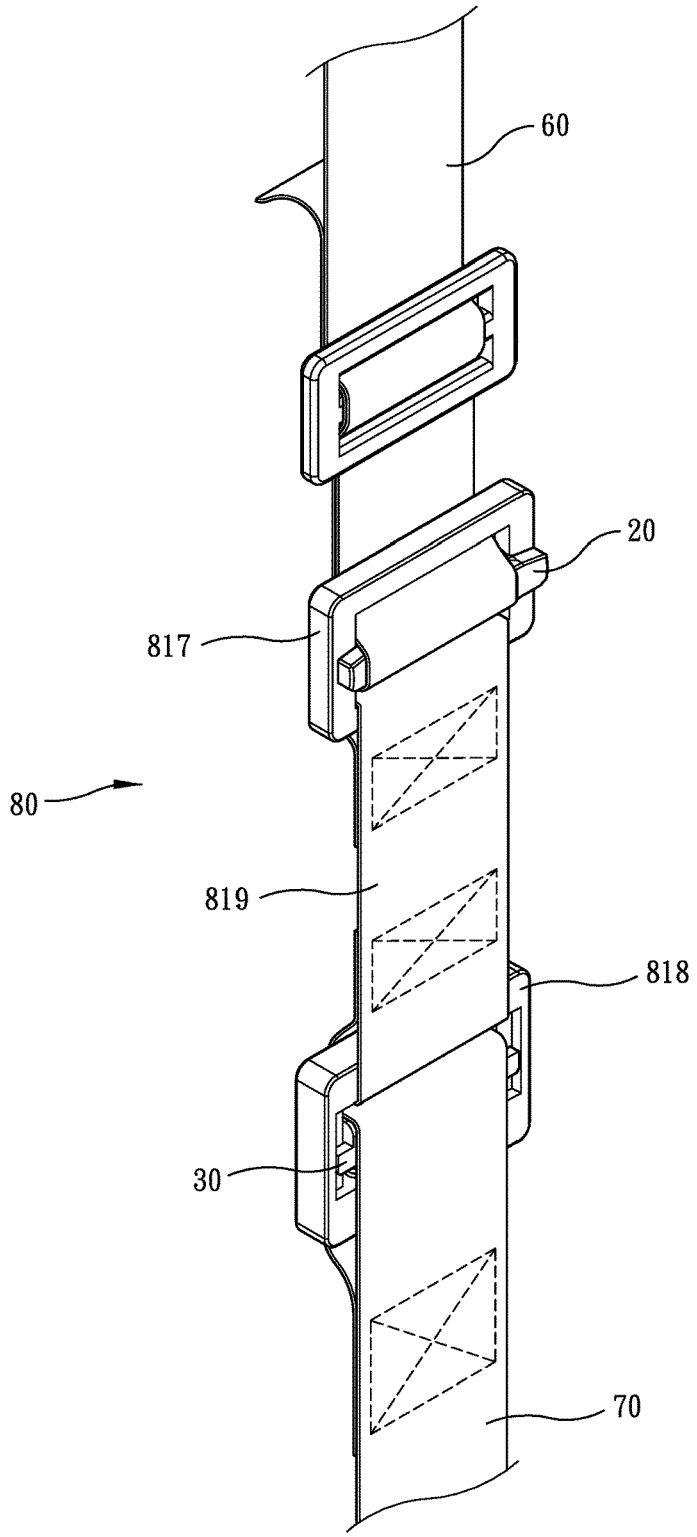
FIG. 11 is a perspective view illustrating a use of the second embodiment of FIG. 10.
Figure 12:
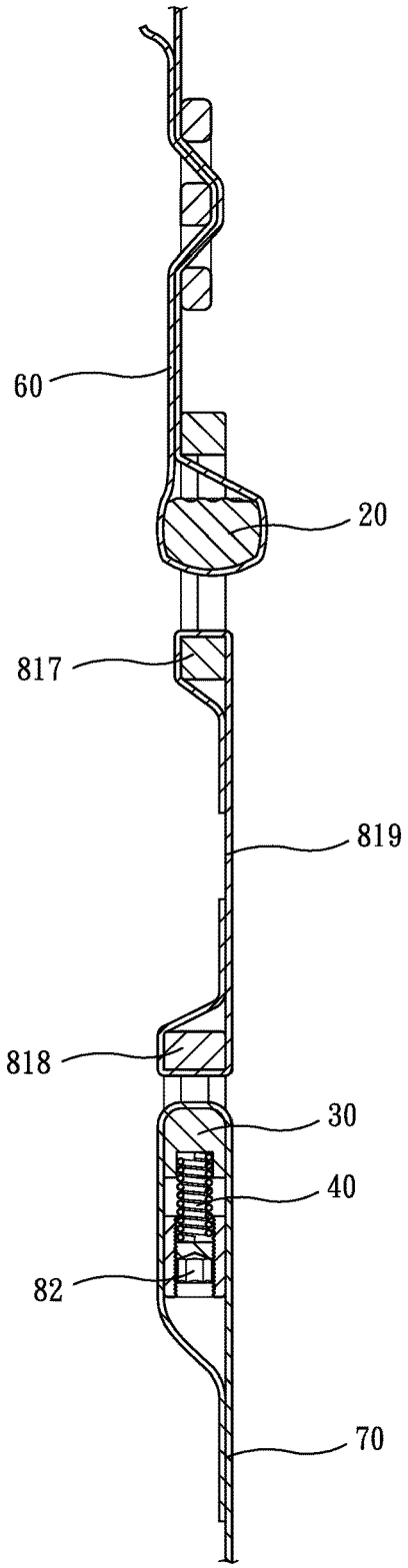
FIG. 12 is a cross-sectional view illustrating a use of the second embodiment of FIG. 10.

Referring to FIGS. 10-12, a strap connector 200 according to a second embodiment of the present invention is provided for a body fitting device and comprises, similar to the first embodiment, a connector body 80, a first movable block 20, a second movable block 30, an elastic assembly 40, and a guide assembly 50. A difference between the first and second embodiments is as follow:

In the instant embodiment, the connector body 80 comprises a connector base 81 and three regulators 82. The connector base 81 comprises a first base 817, a second base 818, and a coupling strap 819. The first base 817 is in the form of a rectangular frame and comprises a first movement space 811 formed in an interior thereof. The first movement space 811 has two opposite inside surfaces each of which is provided with a first movement rail 813. The second base 818 is in the form of a rectangular frame and comprises a second movement space 812. The second movement space 812 has two opposite inside surfaces each of which is provided with a second movement rail 814. The second base 818 has an end wall that comprises three threaded holes 815 and two through holes 816, which are each located between two adjacent one of the threaded holes 815, formed therein to extend from an outside surface thereof to the second movement space 812. The coupling strap 819 is connected between the first base 817 and the second base 818. The remaining parts and assembly are similar to those of the first embodiment and repeated description will be omitted herein.

As such, to use the instant embodiment, as shown in FIGS. 11 and 12, in a way similar to the previous embodiment, the first strap 60 is wrapped around and coupled to the first movable block 20; and the second strap 70 is wrapped around and coupled to the second movable block 30.

When a user pulls the second strap 70, in a way similar to the previous embodiment, the elastic forces generated by the elastic assembly 40 provide a cushioning force for an impact caused by the operation to prevent a shocking impact from occurring on the second movable block 30 during the sliding movement. In this way, the user is provided a better effect of exercise through pulling and is also protected against any potential risk of damage caused by momentary no-resistance sliding.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A strap connector of a body fitting device, comprising:

a connector body, which comprises a first movement space and a second movement space that is separated from the first movement space;

a first movable block, which is slidably mounted to the connector body and is received in the first movement space and is reciprocally slidable upon being acted upon by an external force;

a second movable block, which is slidably mounted to the connector body and is received in the second movement space and is reciprocally slidable upon being acted upon by an external force; and an elastic assembly, which is in contact engagement with and positioned between the connector body and the second movable block to provide an elastic cushioning force to the second movable block.

2. The strap connector of the body fitting device according to claim 1, wherein the second movement space of the connector body is defined between two opposite side surfaces each of which is provided with a first movement rail, and the second movement space is defined between two opposite surfaces each of which is provided with a second movement rail; the first movable block has two lateral end each of which is formed with a first movement channel, and the first movement channels are respectively in sliding engagement with the first movement rails of the connector body to be driven by the external force to reciprocally slide within the first movement space along the first movement rails; the second movable block has two lateral ends each of which is formed with a second movement channel, and the second movement channels are respectively in sliding engagement with the second movement rails of the connector body to be driven by the external force to reciprocally slide within the second movement space along the second movement rails.

3. The strap connector of the body fitting device according to claim 1, wherein the connector body comprises a connector base and at least one regulator; the connector base comprises an integrally formed unitary structure in the form of a rectangular frame, which comprises, formed in an interior thereof, the first movement space and the second movement space, and the connector base has an end wall that comprises at least one threaded hole formed therein to extend from an outside surface thereof to the second movement space; the regulator has an outer circumferential surface on which an external thread is formed and the regulator has an end forming a driving section and an opposite end forming an engaging section, wherein the regulator is in threading engagement with the threaded hole of the connector base by means of the external thread thereof such that the engaging section faces the second movement space and is contact engagement with the elastic assembly.

4. The strap connector of the body fitting device according to claim 3, wherein the regulator comprises a head-less bolt.

5. The strap connector of the body fitting device according to claim 3, wherein the driving section comprises a hexagonal hole.

6. The strap connector of the body fitting device according to claim 3, wherein the elastic assembly comprises at least one spring; and the second movable block has a side formed with at least one constraint hole, wherein the spring is positioned between and in engagement with the constraint hole and the engaging section of the regulator.

7. The strap connector of the body fitting device according to claim 1, wherein the connector body comprises a connector base and at least one regulator; the connector base comprises a first base, a second base, and a coupling strap, wherein the first base is in the form of a frame comprising the first movement space formed therein; the second base is in the form of a frame comprising the second movement space formed therein, the second base having an end wall in which the at least one threaded hole is formed and extends from an outside surface thereof to the second movement space; and the coupling strap is connected between the first base and the second base; the regulator has an outside circumferential surface on which an external thread is formed, the regulator having an end forming a driving section and an opposite end forming an engaging section, the regulator being in threading engagement with the threaded hole of the connector base by means of the external thread thereof such that the engaging section faces the second movement space and is contact engagement with the elastic assembly.

8. The strap connector of the body fitting device according to claim 7, wherein the regulator comprises a head-less bolt.

9. The strap connector of the body fitting device according to claim 7, wherein the driving section comprises a hexagonal hole.

10. The strap connector of the body fitting device according to claim 7, wherein the elastic assembly comprises at least one spring; and the second movable block has a side formed with at least one constraint hole, wherein the spring is positioned between and in engagement with the constraint hole and the engaging section of the regulator.

11. The strap connector of the body fitting device according to claim 1, wherein the first movable block has a surface that comprises a roughened surface.

12. The strap connector of the body fitting device according to claim 1 further comprising a guide assembly, wherein the connector body has an end wall that comprises at least one through hole formed therein and extending from an outside surface of the connector body to the second movement space; and the guide assembly comprises at least one guide member, the guide member comprising a head portion and a shank portion integrally formed with and coaxially connected to the head portion, the head portion having an outside diameter that is greater than an outside diameter of the shank portion, the guide member being arranged such that the shank portion is received through the through hole of the connector body and connected to the second movable block.

13. The strap connector of the body fitting device according to claim 12, wherein the second movable block comprises at least one connection hole, the connection hole being a threaded hole; the shank portion of the guide member has an outside circumferential surface on which an external thread is formed so that the external thread is in screwing engagement with the connection hole.

14. The strap connector of the body fitting device according to claim 12, wherein the through hole of the connector body comprises a small aperture in communication with the second movement space and a large aperture that is coaxial with and in communication with the small aperture and is in communication with the outside surface of the connector body; the guide member comprises a bolt and the outside diameter of the head portion of the guide member is less than a bore diameter of the large aperture of the connector body and greater than a bore diameter of the small aperture and the outside diameter of the shank portion is less than the bore diameter of the small aperture of the connector body.

* * * * *